US010330117B2

(12) United States Patent
Cellier et al.

(10) Patent No.: US 10,330,117 B2
(45) Date of Patent: Jun. 25, 2019

(54) ANGULAR STATOR SECTOR FOR A TURBOMACHINE COMPRESSOR COMPRISING A BRUSH SEAL

(71) Applicant: SAFRAN AIRCRAFT ENGINES, Paris (FR)

(72) Inventors: Damien Joseph Cellier, Paris (FR); Mickael Dias Gomes, Paris (FR); Antoine Robert Alain Brunet, Avon (FR); Daniel Georges Plona, Vulaines sur Seine (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 1282 days.

(21) Appl. No.: 14/478,120

(22) Filed: Sep. 5, 2014

(65) Prior Publication Data

US 2015/0071770 A1 Mar. 12, 2015

(30) Foreign Application Priority Data

Sep. 11, 2013 (FR) ..... 13 58734

(51) Int. Cl.
*F01D 11/00* (2006.01)
*F04D 19/00* (2006.01)
(Continued)

(52) U.S. Cl.
CPC ..... *F04D 29/542* (2013.01); *F01D 11/001* (2013.01); *F04D 19/00* (2013.01); *F04D 29/164* (2013.01); *F05D 2240/56* (2013.01)

(58) Field of Classification Search
CPC ..... F04D 29/542; F04D 29/544
(Continued)

(56) References Cited

U.S. PATENT DOCUMENTS 5,114,159 A * 5/1992 Baird ..... F01D 5/10 277/355
5,328,328 A * 7/1994 Charbonnel ..... F01D 11/001 415/160
(Continued)

FOREIGN PATENT DOCUMENTS

DE 44 46 361 A1 6/1996
DE 10 2008 032 661 A1 1/2010
(Continued)

OTHER PUBLICATIONS

English Translation of WO9942704 (Aug. 26, 1999).*
(Continued)

*Primary Examiner* — Justin D Seabe
*Assistant Examiner* — Jason Mikus
(74) *Attorney, Agent, or Firm* — Oblon, McClelland, Maier & Neustadt, L.L.P.

(57) ABSTRACT

The main object of the invention is an angular stator sector (10) for a turbomachine compressor, comprising an outer shroud and an inner shroud (S) arranged coaxially one inside the other, and at least one vane (P) extending radially between the outer shroud and the inner shroud (S) and connected to the latter by its radial ends, characterized in that the inner shroud (S) comprises at least one brush seal (1, 2, 3) forming an obstacle to the recirculation of the downstream gases upstream of the inner shroud (S).

7 Claims, 3 Drawing Sheets

(51) Int. Cl.
*F04D 29/16* (2006.01)
*F04D 29/54* (2006.01)

(58) Field of Classification Search
USPC ..... 415/173.7
See application file for complete search history.

(56) References Cited

U.S. PATENT DOCUMENTS

| | | | |
|---|---|---|---|
| 5,746,573 | A | 5/1998 | Junkin et al. |
| 7,510,332 | B2 | 3/2009 | Plona |
| 8,011,666 | B2 | 9/2011 | Plona |
| 2014/0248144 | A1 | 9/2014 | Cellier et al. |

FOREIGN PATENT DOCUMENTS

| | | | | |
|---|---|---|---|---|
| FR | 2 973 436 | A1 | 10/2012 | |
| WO | WO 9942704 | A1 * | 8/1999 | ..... F01D 11/001 |

OTHER PUBLICATIONS

French Preliminary Search Report dated May 21, 2014 in French Application 13 58734, filed on Sep. 11, 2013 ( with English Translation of categories of Cited Documents).
U.S. Appl. No. 14/349,000, filed Apr. 1, 2014, 2014-0248144, Cellier, et al.
U.S. Appl. No. 14/538,227, filed Nov. 11, 2014, Plona.

* cited by examiner

ANGULAR STATOR SECTOR FOR A TURBOMACHINE COMPRESSOR COMPRISING A BRUSH SEAL

TECHNICAL FIELD

This invention relates to the field of turbomachines, and more particularly to the field of stators for a turbomachine compressor.

The invention applies to any type of land or aeronautical turbomachine, and in particular to aircraft turbomachines such as turbojets and turboprop engines. More preferably, it applies to a turbofan twin-spool engine.

The invention as such relates more precisely to an angular stator sector for a turbomachine compressor, as well as an associated compressor and turbomachine.

PRIOR ART

A turbomachine compressor is constituted of a plurality of compression stages each formed of an annular row of mobile blades mounted on a shroud of the turbomachine and a stator mounted on an outer annular casing of the turbomachine.

A stator of a compressor can be comprised of a ring, or it can be sectorised (i.e. constituted of a plurality of angular sectors connected end-to-end circumferentially about the longitudinal axis of the compressor). All throughout this application, "angular stator sector" (or "stator sector" for more concision) means, any angular stator sector of which the angle is equal to or less than 360°.

Each stator sector comprises an outer shroud and an inner shroud arranged coaxially one inside the other, and one (or several) vanes extending radially between these shrouds and connected to the latter by its (their) radial end or ends.

In order to provide for the operation of a compressor, there is a space, at each stage, between the stator and the hub, that forms a cavity under the stator. Generally, a leakage rate flows in this cavity, from downstream of the stator upstream, passing under the radially inner end of the inner shroud. The existence of such a leakage rate is often qualified as "re-circulation phenomenon under the stator".

The re-circulation phenomenon under the stator disturbs the main flow of the gases in the turbomachine, and in particular it modifies the flow conditions upstream of the blades. As such, such a phenomenon constitutes a significant factor in the degradation of operability and the loss of performance for any compressor.

In order to fight the recirculation phenomenon under the stator, a solution has already been proposed consisting in the setting up of lips carried by the rotor shroud, in the circuit under the stator. In this way, it is possible to reduce the flow of recirculation of the gases under the inner shroud of the stator. However, this solution has several disadvantages. On the one hand, the cost of setting up lips under the stator is substantial. On the other hand, the effectiveness of the lips strongly depends on the quality of the prediction and manufacture of the latter, and the re-circulation phenomenon under the stator still affects the operation of the compressor.

Moreover, conventionally in the conception of a compressor, it is sought to avoid having ascending steps, in the direction of flow of the gases on the inner wall of the aerodynamic stream, between two successive parts, in particular between a successive platform and shroud. To do this, when considering two successive parts of the compressor, the part located downstream of the other part is designed with a shorter radius than that of the upstream part, with a certain margin aiming to cover the manufacturing tolerances and the uncertainties linked to the thermics of the parts.

In this way, this has for consequence that the inner wall of the aerodynamic stream comprises, in most cases, a descending step between two successive parts, in the direction of flow of the gases. The existence of such descending steps also negatively affects the aerodynamic performance of a compressor.

DESCRIPTION OF THE INVENTION

There is therefore a need to propose a solution that makes it possible to prevent, or at least reduce, the negative impact of the re-circulation phenomena under the stator and the existence of descending steps in a turbomachine compressor, in order to significantly improve the performance of the compressor.

The invention has for purpose to remedy at least partially the aforementioned needs and the disadvantages relating to the embodiments of prior art.

The invention thus has for object, according to one of its aspects, an angular stator sector for a turbomachine compressor, comprising:

- an outer shroud and an inner shroud arranged coaxially one inside the other, and
- at least one vane extending radially between the outer shroud and the inner shroud and connected to the latter by its radial ends, characterised in that the inner shroud comprises at least one brush seal forming an obstacle to the recirculation of the downstream gases upstream of the inner shroud.

In particular, as the stator sector has a cavity referred to as a "cavity under the stator" located radially between the inner shroud and the rotor shroud of the turbomachine, the brush seal advantageously forms an obstacle to the recirculation of the gases in the cavity under the stator, from downstream to upstream of the inner shroud.

Thanks to the invention, it can be possible to significantly and effectively reduce the flow of recirculation of the gases in the cavity under the stator from downstream to upstream of the inner shroud. In addition, the positioning of the brush seal on the inner shroud relatively to a rotor platform located downstream or upstream of said inner shroud can make it possible to extend the pattern of the inner wall of the aerodynamic stream, respectively downstream or upstream of the inner shroud of the stator, in such a way as to prevent at least partially the negative impact of the descending steps. The invention can as such make it possible to significantly improve the aerodynamic performance of the compressor, and the operability of the turbomachine.

The stator sector according to the invention can furthermore comprise one or several of the following characteristics taken individually or according to any technically permissible combination.

The brush seal can be a metal brush seal or, more preferably, a carbon brush seal.

The brush seal can be fastened on the inner shroud, in particular by any type of fastening means known per se.

The number and the arrangement of the brush seal or seals of the stator sector can vary. In particular, three zones of importance can be identified around the inner shroud of the stator, namely: the zone corresponding to the space between the inner shroud of the stator and the downstream rotor platform, the zone corresponding to the space between the inner shroud of the stator and the upstream rotor platform and the zone corresponding to the cavity under the stator.

As such, the inner shroud can comprise a brush seal on its downstream axial end, in other words there is play between stator and downstream rotor. The brush seal can for example then, in this case, be fastened on the inner shroud in a radially outer portion of the downstream axial end of the inner shroud.

The inner shroud can further comprise a brush seal on its upstream axial end, in other words there is play between stator and upstream rotor. The brush seal can for example then, in this case, be fastened on the inner shroud in a radially outer portion of the upstream axial end of the inner shroud.

The inner shroud can further comprise a brush seal on its radial inner end, in other words on the zone of the cavity under the stator. The brush seal can for example then, in this case, be fastened on the inner shroud in a median portion of its radial inner end.

The invention further has for object, according to another of its aspects, a stator of a turbomachine, characterised in that it is formed from one or from a plurality of angular stator sectors such as defined hereinabove.

The invention also has for object, according to another of its aspects, a turbomachine compressor, characterised in that it comprises a stator formed from one or from a plurality of angular stator sectors such as defined hereinabove.

The compressor can comprise:

- a downstream rotor platform located immediately downstream of the inner shroud of the angular stator sector and/or an upstream rotor platform located immediately upstream of the inner shroud of the angular stator sector, and
- a rotor shroud of the compressor connected to the downstream rotor platform and/or the upstream rotor platform, said at least one brush seal being fastened to the inner shroud of the angular stator sector and extending substantially in contact with the downstream rotor platform and/or with the upstream rotor platform and/or with the rotor shroud.

"Located immediately downstream (respectively upstream)" means that the downstream rotor platform (respectively the upstream rotor platform) and the inner shroud are successive parts of the compressor.

"Substantially in contact" means that the bristles of the brush seal can touch or be flush with the surface of the downstream rotor platform and/or with the upstream rotor platform and/or with the rotor shroud. In particular, the brush seal can allow for the forming of an obstacle substantially closing the flow of the downstream gases upstream of the inner shroud, in the space between the upstream rotor and the stator, and/or in the space between the downstream rotor and the stator, and/or in the space between the stator and the rotor shroud (i.e. the cavity under the stator).

The inner shroud of the stator may or may not be preceded and/or followed, from upstream to downstream, by a rotor platform according to the considered stage of the compressor.

The length of the bristles of the brush seal can be defined according to the dimensions of the space between the stator and the downstream rotor, and/or the stator and the upstream, and/or the stator and the rotor shroud.

Moreover, the solution of prior art implementing the use of lips in the cavity under the stator may or may not be combined with the brush seal of the stator sector according to the invention. The brush seal can therefore be a supplement to or be a replacement for the lips.

As such, the inner shroud of the angular stator sector can comprise a brush seal fixed on the radial inner end of the inner shroud, extending substantially in contact with the rotor shroud, and one or several lips can be arranged on the radially outer portion of the rotor shroud by being separated axially from said brush seal.

The number and the arrangement of the lip or lips on the radially outer portion of the rotor shroud in relation to the brush seal fastened on the radial inner end of the inner shroud can vary. Alternatively, the radially outer portion of the rotor shroud can comprise no lip, with only the brush seal of the radial inner end of the inner shroud present.

The axial separation of the lip or lips in relation to brush seal must be enough to limit the risks of contact between the lip or lips and the brush seal.

Moreover, the inner shroud of the angular stator sector can comprise a first brush seal fastened on the downstream axial end of the inner shroud and/or a second brush seal fastened on the upstream axial end of the inner shroud, the first brush seal and/or the second brush seal extending from the inner shroud respectively to the downstream rotor platform and/or the upstream rotor platform according to respectively a first angle and/or a second angle in relation to the axis of rotation of the turbomachine, in such a way as to former an substantially continuous evolution of the inner wall of the aerodynamic stream at the passage between the inner shroud and the downstream rotor platform and/or at the passage between the inner shroud and the upstream rotor platform.

In this way, the substantially continuous evolution of the inner wall of the aerodynamic stream on the spaces between stator and rotor can make it possible to fight against the negative effects of the descending steps since the inner wall of the aerodynamic stream is "smoothed" at the passages between the stator and the downstream rotor, and/or between the stator and the upstream rotor.

The first angle according to which extends the first brush seal can be defined as having a tangent substantially equal to the margin between the radial outer end of the inner shroud of the stator and the radial outer end of the downstream rotor platform, divided by the space between the downstream axial end of the inner shroud of the stator and the upstream axial end of the downstream rotor platform.

Likewise, the second angle according to which extends the second brush seal can be defined as having a tangent substantially equal to the margin between the radial outer end of the upstream rotor platform and the radial outer end of the inner shroud of the stator, divided by the space between the upstream axial end of the inner shroud of the stator and the downstream axial end of the upstream rotor platform.

In the two cases hereinabove, an adjustment coefficient, positive or negative, can where applicable make it possible to modify the value of the first angle and/or of the second angle.

Moreover, the inner shroud of the angular stator sector can comprise a first brush seal fastened on the downstream axial end of the inner shroud and/or a second brush seal fastened on the upstream axial end of the inner shroud, the first brush seal and/or the second brush seal extending from the inner shroud respectively to the downstream rotor platform and/or the upstream rotor platform, respectively substantially in contact with the radial outer end of the downstream rotor platform or with the upstream axial end of the downstream rotor platform, and/or with the downstream axial end of the upstream rotor platform.

In other words, the first brush seal can extend substantially in contact with the radial outer end of the downstream rotor platform or substantially in contact with the upstream axial end of the downstream rotor platform.

Likewise, the second brush seal can extend substantially in contact with the downstream axial end of the upstream rotor platform.

A positioning in contact with the radial outer end of the downstream rotor platform can be preferred in the case of the first brush seal. In this way, it can be possible to limit, and even prevent, any degradation of the first brush seal during axial movements of the fixed and mobile parts (rotor and stator). In addition, this positioning can allow for an accompanying of the gases flowing in the passage between stator and rotor. Alternatively, a positioning in contact with the upstream axial end of the downstream rotor platform can be possible. In this case, it can be possible to obtain a better seal, but also however a possible faster and more substantial degradation of the brush seal.

A positioning in contact with the downstream axial end of the upstream rotor platform in the case of the second brush seal can make it possible to reduce the height of the descending step.

The invention further has for object, according to another of its aspects, a turbomachine, characterised in that it comprises an angular stator sector such as defined hereinabove, a stator such as defined hereinabove or a compressor such as defined hereinabove.

BRIEF DESCRIPTION OF THE DRAWINGS

The invention can be better understood when reading the following detailed description and non-restricted examples of the implementation of the latter, as well as examining the figures, diagrammatical and partial, of the annexed drawing, wherein.

In all of these figures, identical references can designate identical or similar elements.

In addition, the various portions shown in the figures are not necessarily shown according to a uniform scale, in order to make the figures more legible.

DETAILED DESCRIPTION OF PARTICULAR EMBODIMENTS

In all of the description, note that the terms upstream and downstream are to be considered in relation to a main normal direction of flow F of the gases (from upstream to downstream) for a turbomachine. Moreover, axis of the turbomachine refers to the axis of radial symmetry of the turbomachine. The axial direction corresponds to the direction of the axis of the turbomachine, and a radial direction is a direction perpendicular to this axis. Furthermore, except where mentioned otherwise, the adjectives and adverbs axial, radial, axially and radially are used in reference to the aforementioned axial and radial directions. In addition, except where mentioned otherwise, the adjectives inner and outer are used in reference to a radial direction in such a way that the inner portion or face (i.e. radially inner) of an element is closer to the axis of the turbomachine than the outer portion or face (i.e. radially outer) of the same element.

Figure 1:
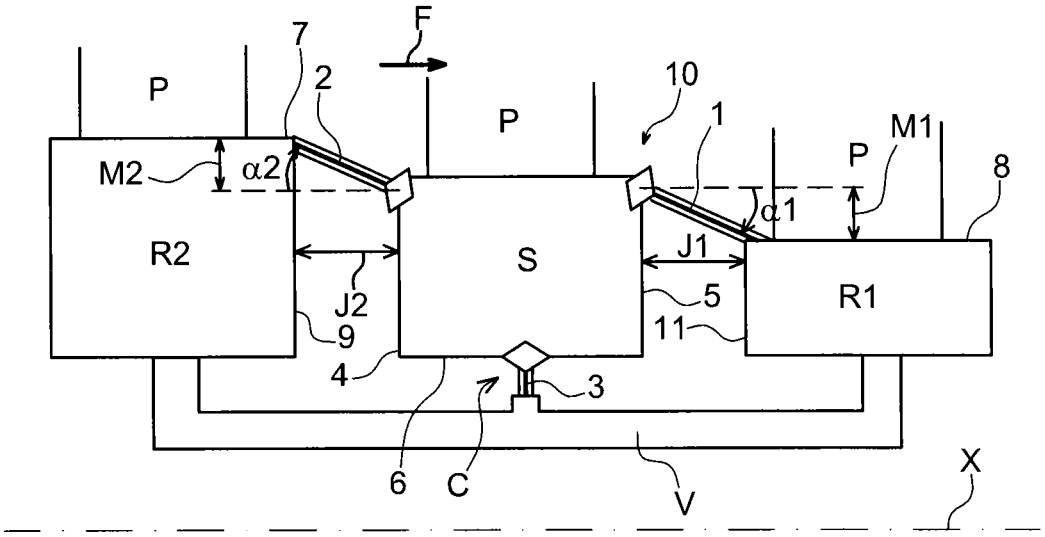
FIG. 1 shows very diagrammatically an example of a compressor comprising a stator sector according to the invention comprising three brush seals.

FIG. 1 shows a partial diagram of a turbomachine compressor showing an example of a stator sector 10 according to the invention.

The stator sector 10 comprises an outer shroud (not shown in the figures but located at the outer end of the vane P) and an inner shroud S, arranged coaxially one inside the other. In addition, the stator sector 10 comprises a vane P extending radially between the outer shroud and the inner shroud S and connected to the latter by its radial ends.

The stator sector 10 is located axially between an upstream rotor platform R2 and a downstream rotor platform R1, each carrying a vane P. The upstream R2 and downstream R1 rotor platforms are moreover connected together by the rotor shroud V of the compressor.

The space located radially between the radial inner end 6 of the inner shroud of the stator S and the rotor shroud V defines a cavity C of the recirculation of the downstream gases upstream of the inner shroud S, with the latter being referred to as "cavity under the stator".

In accordance with the invention, the inner shroud S of the stator sector 10 comprises at least one brush seal forming an obstacle to the recirculation of the downstream gases upstream of the inner shroud S.

Various configurations are possible concerning the number and the arrangement of the brush seals of the inner shroud S. For example, the inner shroud S can comprise a single brush seal, located for example at an axial end of the inner shroud S, for example the upstream end 4 or the downstream end 5 as according to the examples of FIGS. 2 and 4, or be located at the radial inner end 6 of the inner shroud S as according to the example of FIGS. 3A, 3B and 3C. Alternatively, the inner shroud S can comprise two brush seals, for example located respectively on the upstream 4 and downstream 5 axial ends of the inner shroud S, or one located on the radial inner end 6 of the inner shroud S and the other located on the upstream 4 or downstream 5 axial end of the inner shroud S.

Advantageously in the example of FIG. 1, the inner shroud S comprises three brush seals 1, 2 and 3 in order to form obstacles to the recirculation of the gases in the cavity C under the stator, from downstream to upstream of the inner shroud S. In particular, the inner shroud S comprises a first brush seal 1 located on the downstream axial end 5 of the inner shroud S, a second brush seal 2 located on the upstream axial end 4 of the inner shroud S and a third brush seal 3 located on the radial inner end 6 of the inner shroud S.

As such, the inner shroud S of FIG. 1 comprises three brush seals 1, 2 and 3 located at three key locations of the cavity C under the stator, i.e. respectively on space J1 between the inner shroud of the stator S and the downstream rotor platform R1, on space J2 between the inner shroud of the stator S and the upstream rotor platform R2 and on the cavity C under the stator between the radial inner end 6 of the inner shroud of the stator S and the rotor shroud V. The invention can as such make it possible to control the recirculation of gases under the stator thanks to the setting up of obstacles in the form of brush seals.

The first brush seal 1 can as such make it possible to extend the pattern of the inner wall of the aerodynamic stream downstream of the inner shroud of the stator S, and the second brush seal 2 can make it possible to extend the pattern of the inner wall of the aerodynamic stream upstream of the inner shroud of the stator S. It can as such be possible to limit, and even prevent, the negative effects due to the presence of descending steps.

More particularly, the first brush seal 1 extends from the inner shroud S to the downstream rotor platform R1 according to a first angle $\alpha 1$ in relation to the axis of rotation X of the turbomachine in such a way as to form a substantially continuous evolution of the inner wall of the aerodynamic stream at the passage between the inner shroud S and the downstream rotor platform R1.

The first angle $\alpha 1$ can in particular be defined by the following relation:

$$\tan \alpha 1 \approx (M1/J1) - \varepsilon 1,$$

where M1 corresponds to the margin between the radial outer end of the inner shroud of the stator S and the radial outer end 8 of the downstream rotor platform R1, J1 corresponds to the space between the downstream axial end 5 of the inner shroud of the stator S and the upstream axial end 11 of the downstream rotor platform R1, and $\varepsilon 1$ corresponds to an adjustment coefficient that makes it possible to adjust the value of the first angle $\alpha 1$ in such a way that the first brush seal 1 is flush on the radial outer end 8 (case of FIG. 2 wherein, in this case, $\varepsilon 1$ is positive) or on the upstream axial end 11 of the downstream rotor platform R1 (case of FIG. 4 where, in this case, $\varepsilon 1$ is negative) when the engine is operating. In the absence of such an adjustment coefficient, the first brush seal 1 would be flush with the corner of the downstream rotor platform R1.

Likewise, the second brush seal 2 extends from the inner shroud S to the upstream rotor platform R2 according to a second angle $\alpha 2$ in relation to the axis of rotation X of the turbomachine in such a way as to form a substantially continuous evolution of the inner wall of the aerodynamic stream at the passage between the inner shroud S and the upstream rotor platform R2.

The second angle $\alpha 2$ can in particular be defined by the following relation:

$$\tan \alpha 2 \approx (M2/J2) - \varepsilon 2,$$

where M2 corresponds to the margin between the radial outer end 7 of the upstream rotor platform R2 and the radial outer end of the inner shroud of the stator S, J2 corresponds to the space between the upstream axial end 4 of the inner shroud of the stator S and the downstream axial end 9 of the upstream rotor platform R2, and $\varepsilon 2$ corresponds to a positive adjustment coefficient that makes it possible to adjust the value of the second angle $\alpha 2$. In particular, the angle $\alpha 2$ can be adjusted in such a way as to ensure that, under no cases of operation of the engine, the brush seal 2 represents an ascending step for the flow. The brush seal 2 can therefore be positioned under the upstream rotor platform R2, i.e. at a distance from the radial outer end 7 of the upstream platform R2 in a manner similar to the example of FIG. 4.

The second angle $\alpha 2$ can be determined in comparison to the first angle $\alpha 1$ in such a way that the descending step formed by the second brush seal 2 is more marked (i.e. with a more substantial slope) than the descending step formed by the first brush seal 1.

The brush seal or seals can be chosen for example from among metal brush seals and/or, more preferably, carbon brush seals.

Figure 2:
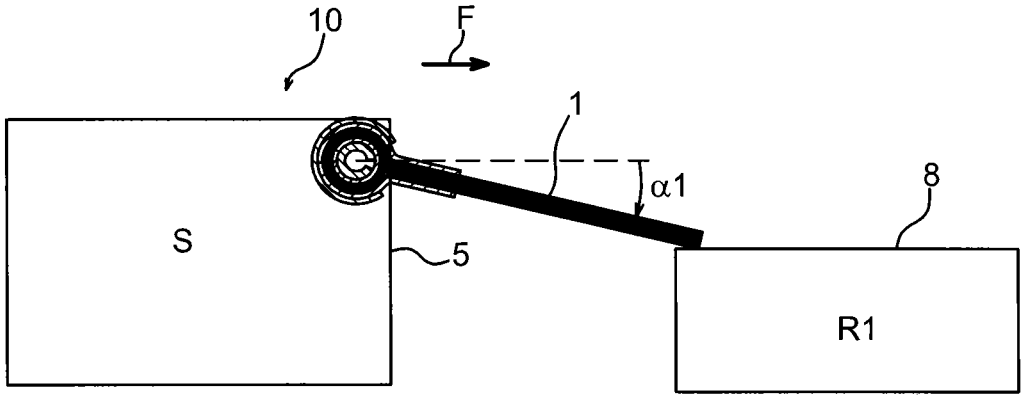
FIG. 2 shows an example of an arrangement of a brush seal on the inner shroud of a stator sector according to the invention.
Figure 4:
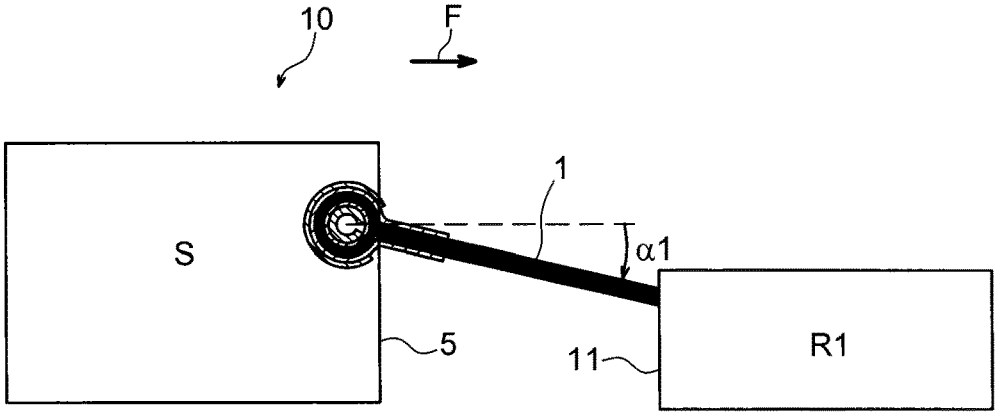
FIG. 4 shows an alternative embodiment of the arrangement of the brush seal on the inner shroud of the stator sector of FIG. 2.

The fastening of a brush seal on the inner shroud S can be carried out in various ways. FIGS. 2 and 4 show as such two alternative arrangements of the first brush seal 1 located on the downstream axial end 5 of the inner shroud S relatively to the latter.

FIG. 2 shows a first arrangement of the first brush seal 1 relatively to the downstream rotor platform R1.

In this example, the first brush seal 1 extends from the inner shroud S to the downstream rotor platform R1, substantially in contact with the radial outer end 8 of the downstream rotor platform R1. In this way, it can be possible to limit, and even prevent, any degradation of the first brush seal 1 during axial movements of the fixed S and mobile R1 parts (rotor and stator). In addition, this first arrangement can allow for an accompanying of the gases flowing in the passage between stator S and rotor R1.

FIG. 4 shows a second arrangement of the first brush seal 1 relatively to the downstream rotor platform R1.

In this example, the first brush seal 1 extends from the inner shroud S to the downstream rotor platform R1 substantially in contact with the upstream axial end 11 of the downstream rotor platform R1. In this case, it can be possible to obtain a better seal.

The brush seal 1 of the examples of FIGS. 2 and 4, carried by the downstream axial end 5 of the inner shroud S, can have an integrity that is not jeopardised by the axial or radial movements.

Moreover, the brush seal or seals, and in particular the brush seal 3 located on the radial inner end 6 of the inner shroud S, may or my not be used in combination with lips L carried by the rotor shroud V in order to form an obstacle to the recirculation of the gases in the cavity C under the stator, from downstream to upstream of the inner shroud S.

Figure 3A:
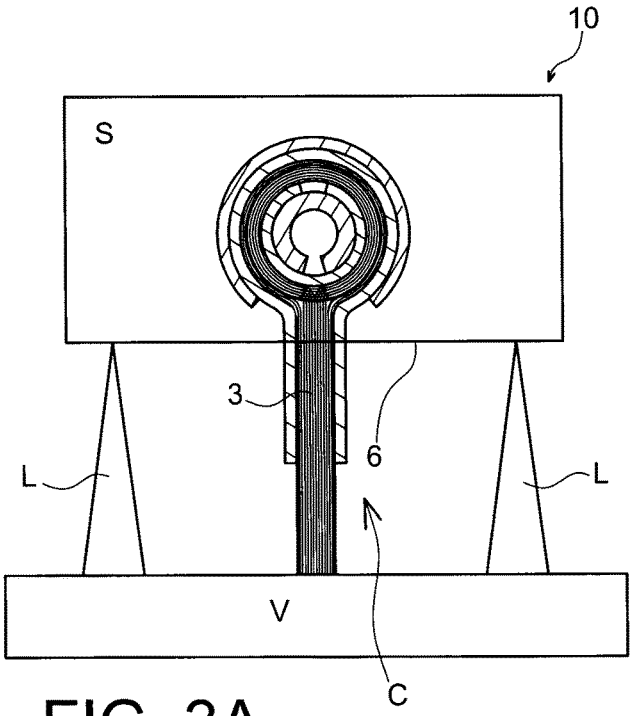
FIGS. 3A, 3B and 3C show different possible configurations of an arrangement of a brush seal on an inner shroud of a stator sector according to the invention, with the presence of lips on the rotor shroud.
Figure 3B:
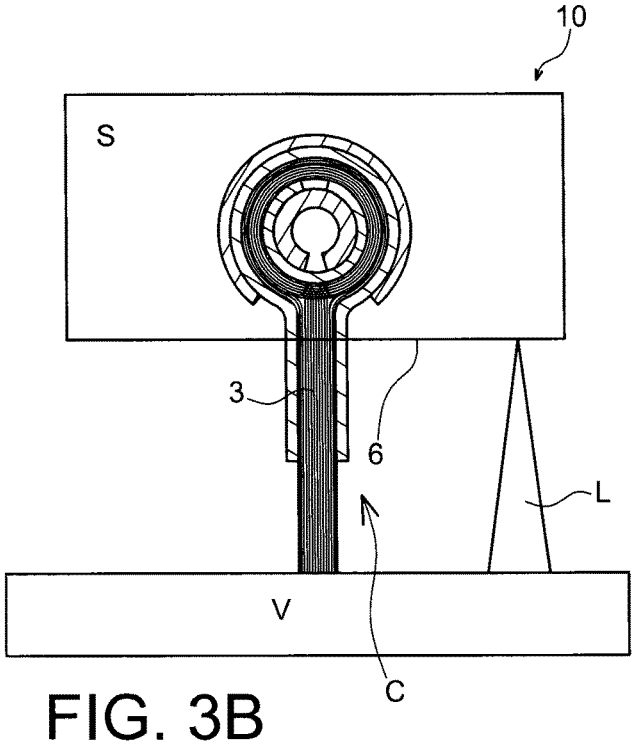
Figure 3C:
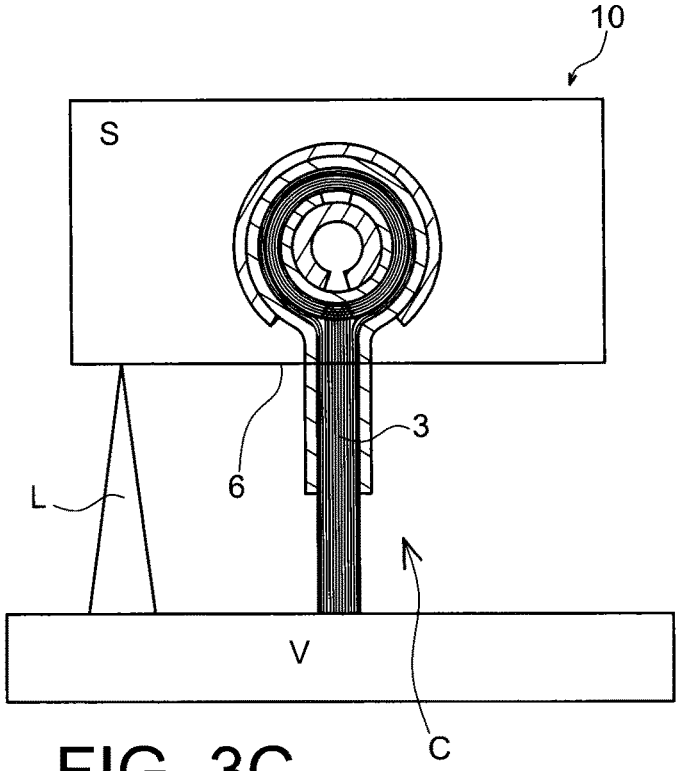

FIGS. 3A, 3B and 3C show possible configurations of the arrangement of the lips L relatively to the brush seal 3 located on the radial inner end 6 of the inner shroud S. In these figures, the inner shroud S comprises only a single brush seal 3. Of course, the inner shroud S could alternatively comprise several brush seals, in particular according to the configurations described hereinabove.

The lips L are distributed on the rotor shroud V in such a way as to be separated from the brush seal 3 in order to limit the risks of contact between the lips L and the brush seal 3.

The rotor shroud V can thus comprise one or several lips L, for example two lips L upstream and downstream of the brush seal 3, on either side of the latter, as according to FIG. 3A, or one lip downstream of the brush seal 3 as according to FIG. 3B, or finally one lip upstream of the brush seal 3 as according to FIG. 3C.

Alternatively, no lip L could be present on the rotor shroud V, and only the brush seal 3 would extend in the cavity C under the stator.

The first brush seal 1 and/or the second brush seal 2 can be located flush with the radial outer end of the inner shroud S (as shown in FIG. 2) or at a distance from the radial outer end of the inner shroud S (as shown in FIG. 4).

Of course, the invention is not limited to the embodiments that have just been described. Various modifications can be carried out by those skilled in the art.

The various configurations (or combinations) shown hereinabove of the brush seals 1, 2 and 3 on the inner shroud S, whether or not associated with the presence of lips L on the rotor shroud V, can be repeated axially in order to improve the seal and the effectiveness of the reduction of the flow of the recirculation of the gases in the cavity C under the stator.

The expression "comprising one" must be understood as being a synonym for "comprising at least one", except where the contrary is mentioned.

The invention claimed is:

1. A turbomachine compressor, comprising:

a stator formed from an angular stator sector or from a plurality of angular stator sectors, comprising:

an outer shroud and an inner shroud arranged coaxially one inside the other, and at least one vane extending radially between the outer shroud and the inner shroud and connected to the outer shroud and the inner shroud by radial ends of the at least one vane, with the inner shroud comprising at least one brush seal forming an obstacle to the recirculation of the downstream gases upstream of the inner shroud, with the turbomachine compressor further comprising:

a downstream rotor platform located immediately downstream of the inner shroud of the angular stator sector and/or an upstream rotor platform located immediately upstream of the inner shroud of the angular stator sector, and a rotor shroud of the turbomachine compressor connected to the downstream rotor platform and/or the upstream rotor platform, said at least one brush seal being fastened to the inner shroud of the angular stator sector and extending in contact with the downstream rotor platform and/or with the upstream rotor platform and/or with the rotor shroud, wherein the inner shroud of the angular stator sector comprises a first brush seal fastened on a downstream axial end of the inner shroud, the first brush seal extending from the inner shroud to the downstream rotor platform in contact with a radial outer end of the downstream rotor platform.

2. The turbomachine compressor according to claim 1, wherein the inner shroud comprises a second brush seal on an upstream axial end of the inner shroud.

3. The turbomachine compressor according to claim 1, wherein the inner shroud comprises a brush seal on a radial inner end of the inner shroud.

4. The turbomachine compressor according to claim 1, wherein the inner shroud of the angular stator sector comprises a brush seal fastened on a radial inner end of the inner shroud, extending in contact with the rotor shroud, and wherein one or several lips are arranged on a radially outer portion of the rotor shroud by being axially separated from said brush seal.

5. The turbomachine compressor according to claim 1, wherein the first brush seal and/or a second brush seal are extending from the inner shroud to the downstream rotor platform and/or the upstream rotor platform, respectively, according to a respective first angle and/or a respective second angle in relation to an axis of rotation of a turbomachine, in such a way as to form a continuous evolution of an inner wall of an aerodynamic stream at a passage between the inner shroud and the downstream rotor platform and/or at a passage between the inner shroud and the upstream rotor platform.

6. A turbomachine comprising the turbomachine compressor as claimed in claim 1.

7. The turbomachine compressor according to claim 1, wherein the inner shroud of the angular stator sector comprises a second brush seal fastened on an upstream axial end of the inner shroud, the second brush seal extending from the inner shroud to the upstream rotor platform in contact with a downstream axial end of the upstream rotor platform.

* * * * *